United States Patent [19]

Juvonen

[11] 4,022,108

[45] May 10, 1977

[54] HYDRAULICALLY OPERATED PERCUSSION DEVICE

[75] Inventor: Vaino Esko Juvonen, Klaukkala, Finland

[73] Assignee: Linden-Alimak AB, Skelleftea, Sweden

[22] Filed: Apr. 16, 1975

[21] Appl. No.: 568,686

[30] Foreign Application Priority Data

Apr. 20, 1974 Finland ..... 1193/74

[52] U.S. Cl. ..... 91/276; 91/303; 91/319; 91/321; 91/328

[51] Int. Cl.[2] ..... F01B 7/18; F01L 25/06

[58] Field of Search ..... 91/303, 276, 321, 314, 91/328, 286

[56] References Cited

UNITED STATES PATENTS

| | | | |
|---|---|---|---|
| 3,766,830 | 10/1973 | Montabert | 91/321 |
| 3,774,502 | 11/1973 | Arndt | 91/321 |
| 3,896,889 | 7/1975 | Bouyoucos | 91/321 |
| 3,925,985 | 12/1975 | Peterson | 91/321 |

*Primary Examiner*—Paul E. Maslousky
*Attorney, Agent, or Firm*—Cushman, Darby & Cushman

[57] ABSTRACT

A hydraulically operated percussion apparatus comprising a housing in which a reciprocating impact piston is arranged to transfer impact energy to an impact tool, pressure chambers defined between said housing and said piston, and a channel system including a high pressure and a low pressure branch for conducting hydraulic pressure fluid to and from the pressure chambers, a first one of said chambers containing a movable distribution valve member responsive to the movements of the piston for alternately connecting said first chamber to said high pressure branch and said low pressure branch, respectively, characterized in that said valve member is arranged to be transported by the piston when moving in one direction, and responsive to the movement of the piston in the other direction to be acted upon by the pressure fluid to move in said other direction by means of hydrostatic pressure, said valve member having a longer path of movement than the impact piston and being arranged, at its movement in said one direction, and by virtue of its kinetic energy, to continue its movement and open said first pressure chamber towards said high pressure branch and close it towards said low pressure branch, when the piston hits said tool.

4 Claims, 1 Drawing Figure

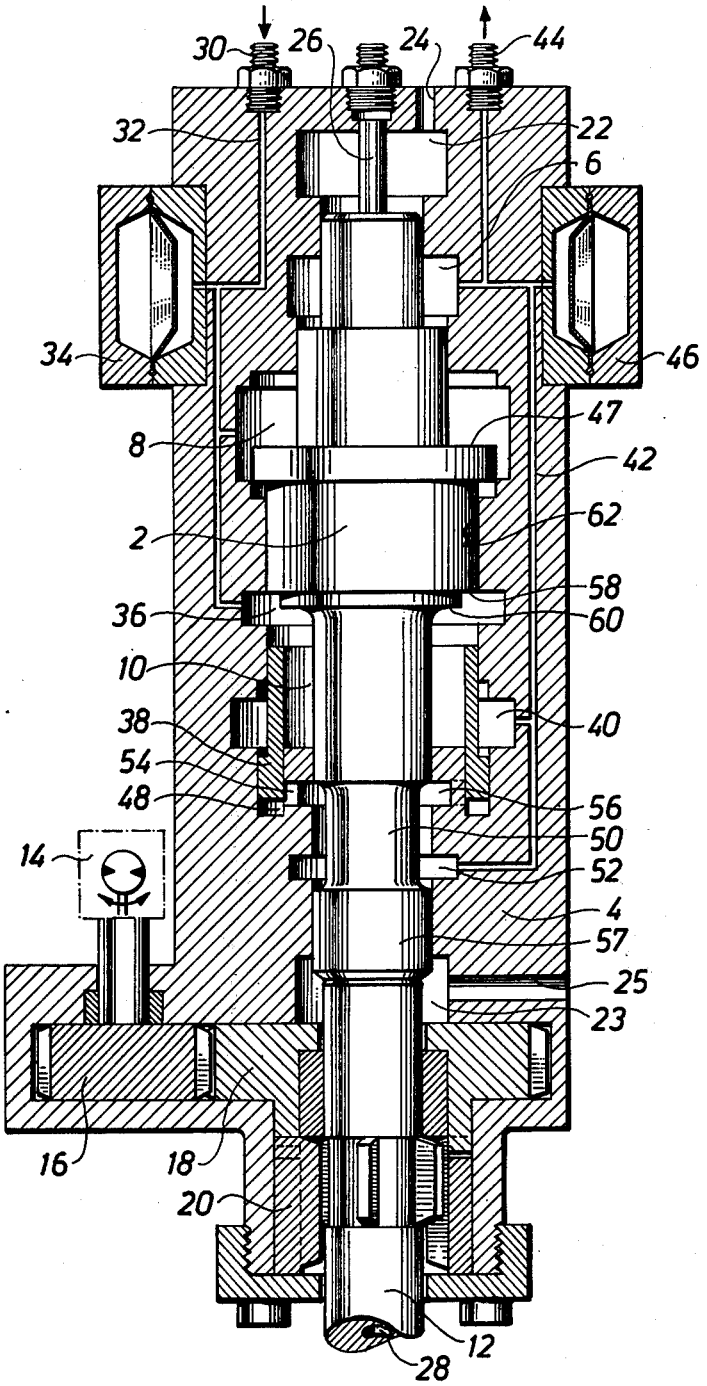
30
26
24
44
32
22
6
34
46
47
8
42
62
2
58
36
60
10
38
40
54
48
56
50
14
52
4
57
25
23
16
18
20
12
28

HYDRAULICALLY OPERATED PERCUSSION DEVICE

The present invention relates to a hydraulically operated percussion device comprising a housing in which a reciprocating impact piston is arranged to transfer impact energy to an impact tool, pressure chambers defined between said housing and said piston, and a channel system including a high pressure and a low pressure side for conducting hydraulic pressure fluid to and from the pressure chambers, a first one of said chambers containing a movable distribution valve member responsive to the movements of the piston for alternately connecting said first chamber to said high pressure side and said low pressure side, respectively.

In the later years a number of different constructions of hydraulically operated percussive machines have been developed, especially for rock drills. Hydraulic operation has the advantage of better economy compared with pneumatic operation.

Hardly any development has, hower, led to such a safe device, which could compete with regard to durability and power with modern pneumatic rock drills.

The greatest problems in connection with hydraulically operated devices are:

1. The slide valves for hydraulic fluid, intended to distribute the pressure acting upon the piston. Attempts to design and arrange said slide valves so as to bring the piston to reciprocate fast enough, have not been successful.

2. The wearing of the impact head of the piston and its influence on operation.

3. The synchronisation of the slide valve movements with the reciprocation of the impact piston. For a closer understanding of these difficulties the operation of percussive machines is to be described generally. By leading oil under pressure in a suitable way to chambers defined between the body of the machine and the pressure acting surfaces of the impact piston, the piston is made to reciprocate as intended. The piston makes a power stroke when it is moving towards the drill steel and a return stroke when it is moving to the opposite direction. During the power stroke the hydrostatic pressure energy is transferred into kinetic energy of the piston which when the piston suddenly hits the drill steel, is transferred through the drill steel as in impact wave to the drill bit and the rock. At that moment such a great force action is generated between the drill bit and the rock that the rock is crushed. Part of the impact wave is reflected from the rock and the drill steel bringing the piston to perform a backward movement with a rather great velocity, called rebound velocity.

In this way the system including the drill steel, the bit and the rock can be compared to a kind of damped spring upon which the piston acts. Variations as regards the art and homogenity of the rock and other similar parameters cause changes in the features of the imagined spring, and thus influence inter alia the transmitting time of impact and the rebound velocity of the piston.

Thus the stroke length and blow rate of piston tend to change all the time. Present distributing valves cannot respond to these variations in a satisfactory way. In some earlier devices this disadvantage is avoided by systems, in which there are, except one inevitable slide valve, also a lot of auxiliary valves for keeping the impact energy and the blow rate constant.

When taking into consideration the high pressure hydraulic operation, small tolerances, mutual plays and fine surfaces of the moving parts, and difficult operation conditions like strong vibration, dirt, and temperature variations of the operation medium, etc., it is clear that the reliability decreases the more there are auxiliary valves, springs and other vibration sensitive moving parts in the machines.

As a successful solution can neither another earlier system be regarded, in which the piston hits the slide valve against the body of the machine at the end of the return stroke, because this solution does not allow for variations of the stroke and return velocity, and because it is sensitive to wearing and involves a risk for breaking loose metal particles. A further disadvantage of conventional hydraulic rock drills is also the wearing of the impact head of the piston, causing a considerable reduction of the impact energy. This is due to the fact that, when the piston is worn, a distance measured from the impact head to an angular recess in the piston becomes shorter, resulting in lost control of the slide valve.

One object of the invention is to provide a new and improved percussion device, especially one in which the aforementioned disadvantages in connection with earlier devices are avoided. This and other objects have, according to the invention, been attained in a hydraulically operated percussion device of the kind referred to by way of introduction, in that said valve member is arranged to be transported by the piston when moving in one direction, and responsive to the movement of the piston in the other direction to be acted upon by the pressure fluid to move in said other direction by means of hydrostatic pressure.

The advantages and features of the present invention will become more readily apparent from the following description with reference to the accompanying drawing, on which the single FIGURE, partly in a longitudinal section, illustrates an embodiment.

An impact piston 2 is arranged to reciprocate in a machine housing 4. The piston 2 and the housing 4 define between them three cylindric pressure chambers 6, 8 and 10. At one end of the housing 4 a drill steel 12 is demountably mounted, the piston 2 being arranged to transmit impact energy to said drill steel. A rotational motor 14 is arranged to transmit, via a gear transmission 16, 18 and a splined bushing 20 mounted in the housing 4, a rotating movement to the drill steel 12. Elements 14, 16, 18, 20 and their connections to the drill steel 12 may be of a conventional type and need therefore not be described closer here.

At each end of the piston 2 chambers 22 and 23, respectively, are located in the housing 4. Chambers 22 and 23 are via bores 24 and 25 respectively, open to the atmosphere. In a conventional way a flushing medium input tube 26 is arranged to conduct, via a central bore, not shown, in piston 2, flushing fluid to a central bore 28 in the drill steel 12. The chambers 22 and 23 and their outlets 24 and 25 respectively, permit that flushing fluid overflowing due to the reciprocating movement of the piston 2 may be conducted away.

The operating fluid, i.e. a pressure liquid such as oil, is fed into the machine via a hose adapter 30, from which a high pressure channel 32 extends into the housing 4. The high pressure channel 32 is connected to a hydro-pneumatic accumulator 34, which contains gas, e.g nitrogen. The accumulator 34 may be of a conventional type usually used for balancing pressure variations in hydraulic machines. An accumulator of membrane type is illustrated on the drawing.

The high pressure channel 32 is directly connected to the chamber 8 and is also connected to an annular groove 36 opening into the chamber 10 as shown. In the cylindric chamber 10 a distributing valve element in the form of a sleeve-like slide element 38 is arranged to be reciprocatingly movable. The element 38 and the wall of the chamber 10 form a distributing valve which is able to close and open the communication between the groove 36 and chamber 10. An annular groove 40 extending along the circumference of the chamber 10 is connected to a low pressure channel 42 and can also be closed and opened with regard to the chamber 10 means of the element 38. The chamber 10, the grooves 36 and 40 and the slide element 38 are dimensioned such that always one of the grooves 36 and 40 is closed towards the chamber 10 by means of the slide element 38 when the respective other groove is open towards said chamber.

The low pressure channel 42 is directly connected to a hose adapter 44 for conducting away pressure fluid from the machine. Also the low pressure channel 42 is connected to an accumulator 46, which can be of the same kind as the accumulator 34, and is intended for balancing pressure variations. The low pressure channel 42 furthermore directly communicates with the chamber 6, here also called the low pressure chamber.

In the chambers 6, 8 and 10 the piston 2 has effective piston surfaces formed by shoulders on the piston in said chambers and dimensioned such that the pressure in the high pressure chamber 8 acting upon the piston surface indicated 47 forces the piston to make a power stroke towards the drill steel 12, if the chamber 10 by virtue of the function of the slide element 38 is connected to the low pressure channel 42, and a return stroke if the chamber 10 is connected to the high pressure channel 32. As is evident from the drawing the volume of the chamber 6 is affected by the position of the piston 2 such that said volume increases during the power stroke. Thereby the pressure in the low pressure channel 42 will decrease to reduce pressure losses when the pressure fluid flows out from the chamber 10.

In the bottom of the chamber 10 an annular groove 48 is located. Said groove may be alternately connected via an annular recess 50 in the mantle surface of the piston 2 to the chamber 10 and to an annular groove 52, respectively, the latter being directly connected to the low pressure channel 42. More particularly the annular groove 48 communicates via bores 54 with a further annular groove 56, which may be brought into communication with the chamber 10 or the groove 52 via the recess 50, depending upon the position of the piston 2. When the slide element 38 is in the position where the annular groove 36 is closed, the chamber 48 communicates with the chamber 10 and, via the groove 40, with the low pressure channel 42.

The slide element 38 is, according to the invention, arranged to be transported, during the power stroke, by the piston 2 until the piston hits the drill steel 12, the element 38 then continuing to move in the direction of the power stroke by virtue of its kinetic energy. On the drawing the piston 2 is illustrated in the position it takes at the moment it has hit the drill steel and is going to begin the return stroke. The high pressure groove 36 is dimensioned such that the connection with the chamber 10 is opened after that the piston has hit the drill steel, due to the velocity difference between the piston and the distributor 38. After the impact the piston can freely rebound in the direction of the return stroke which is needed to provide great enough return velocity. The annular chamber 48 is now connected to the low pressure channel 42 via bores 54, the groove 56, the recess 50 and the groove 52.

When the piston has returned so far that the piston recess 50 opens the connection from the chamber 48 to the chamber 10, the low pressure channel is closed at the groove 52 by the piston head indicated 57, so that the high pressure enters the chamber 48.

Due to the fact that the slide element 38 is designed in the way shown on the drawing with a greater wall thickness at the end turned to the chamber 48, and thus has a greater pressure surface there than at its other end, a force is acting on the slide element, that moves it in the same direction as the return stroke of the piston until the high pressure groove 36 is closed, the chamber 10 then being simultaneously connected with the low pressure channel 42 via the groove 40, thus opened. A new power stroke now begins, due to the pressure in the chamber 8 against the piston surface 47.

The mechanical contact between the piston 2 and the slide element 38 is hydraulically damped by a convenient design of the respective parts. For this purpose the piston 2 is designed with double angular shoulders 58, 60 turned towards the chamber 10. The difference between the radii of said shoulders is such, as compared with the wall thickness of the sleeve 38 at the end thereof turned towards said shoulders, that an annular chamber is formed between the shoulders, the inner wall 62 of the housing and said end of the sleeve 38, when the piston and the sleeve approach their upper position. The inner radius of the sleeve 38 is somewhat greater than the radius of the shoulder 60 so that the chamber is closed with a convenient clearance between the edge of the shoulder 60 and the inner end edge of the sleeve.

The invention is not restricted to the embodiment described above and shown on the drawing but can be modified within the scope of the claims. The invention can thus also be used in percussion machines having no rotating motor and/or where the drill steel is replaced by another tool like a pick, a chisel or a spade, that can be used e.g. to break, asphalt, ground frost, rock and to drive piles.

I claim:

1. In a hydraulically operated percussion apparatus comprising a housing having a bore in which an impact piston is reciprocatingly movable for transferring impact energy to an impact tool, pressure chambers defined between said housing and said piston, and a channel system including a high pressure branch and a low pressure branch for conducting hydraulic pressure fluid to and from the pressure chambers, a first one of said chambers in a ringlike manner surrounding said piston and being defined, at its end remote from the impact tool, by an annular shoulder on said piston, and at its opposite end, by an annular surface of said housing, first and second port means, opening into said first chamber and communicating respectively with said high pressure branch and low pressure branch, said second port means being located between said first port means and said annular surface of said housing, a sleeve shaped distribution valve member surrounding said piston in said first chamber being reciprocatingly movable in response to the reciprocating movement of the piston for alternately covering and uncovering said first and second ports, the improvement that said annular surface of said housing has an annular groove into which one end of said valve member slidingly fits when said second port is covered by said valve member, third and fourth port means in the surface of said bore below said annular surface, said third port means communicating with the bottom of said annular groove and said fourth port means communicating with said low pressure branch, said piston having a mantle surface having recess means therein located to connect said third and fourth port means to each other when the piston is in its end position contacting the tool, and to connect said third port means with said annular chamber when the piston is in a position between its extreme end positions.

2. Apparatus as in claim 1 wherein a second one of said pressure chambers is continuously connected to said high pressure branch and contains a pressure acted surface of the piston, against which the pressure fluid acts during the power stroke of the piston, when said first pressure chamber is connected to said low pressure branch.

3. Apparatus as in claim 1 wherein said distribution valve member has an end position, remote from said annular groove, in which position the end of said valve member remote from said groove, said annular shoulder of said piston, said bore and the mantle surface of said piston define a closed chamber.

4. Apparatus as in claim 1 wherein another one of said pressure chambers is continuously connected to said low pressure branch and defined between said piston and said housing such that the volume of said another pressure chamber increases during movement of the piston in a direction toward from the tool.

* * * * *